United States Patent [19]

Roope, Jr.

[11] 4,372,243

[45] Feb. 8, 1983

[54] TOOL AND PARTS CATCHER FOR BOATS

[76] Inventor: John R. Roope, Jr., 6th and Grove Sts., Rehoboth Beach, Del. 19971

[21] Appl. No.: 284,342

[22] Filed: Jul. 17, 1981

Related U.S. Application Data

[63] Continuation of Ser. No. 112,930, Jan. 17, 1980, abandoned.

[51] Int. Cl.[3] ..... B63B 17/00

[52] U.S. Cl. ..... 114/364; 114/343; 440/113

[58] Field of Search ..... 440/900, 71, 72, 113; 441/136; 114/343, 364, 362

[56] References Cited

U.S. PATENT DOCUMENTS

| | | | |
|---|---|---|---|
| 2,503,602 | 4/1950 | Titley | 5/94 |
| 3,587,123 | 6/1971 | Boyle | 441/362 |
| 3,693,573 | 9/1972 | Murphy | 114/219 |
| 3,805,722 | 4/1974 | Melchert | 114/270 |
| 3,822,422 | 7/1974 | Buntyn | 5/114 |
| 3,886,889 | 6/1975 | Burger | 440/113 |
| 3,956,781 | 5/1976 | Reemelin | 5/114 |
| 4,074,791 | 2/1978 | Inman | 182/138 |

FOREIGN PATENT DOCUMENTS

| | | | |
|---|---|---|---|
| 608311 | 4/1934 | Fed. Rep. of Germany | 182/138 |

*Primary Examiner*—Charles E. Frankfort
*Assistant Examiner*—Stephen P. Avila
*Attorney, Agent, or Firm*—B. P. Fishburne, Jr.

[57] ABSTRACT

A substantially level tray-like barrier is suspended from the stern of a motorboat somewhat above water level and below the frame of an outboard motor to intercept tools or engine parts which may be dropped by a mechanic working on the engine from a position in the stern of the boat to thereby prevent loss of expensive tools and parts in the water. The flexible barrier body of the device adjusts snugly around the outboard motor frame regardless of the size of the motor.

1 Claim, 6 Drawing Figures

FIG. 1
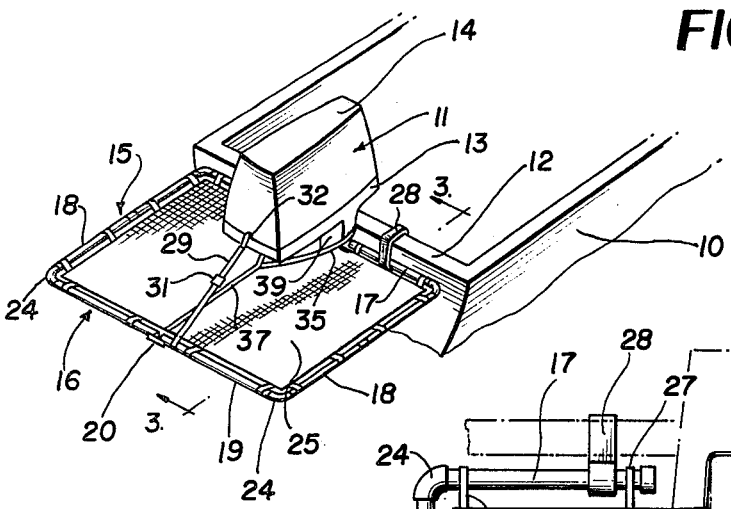
FIG. 2
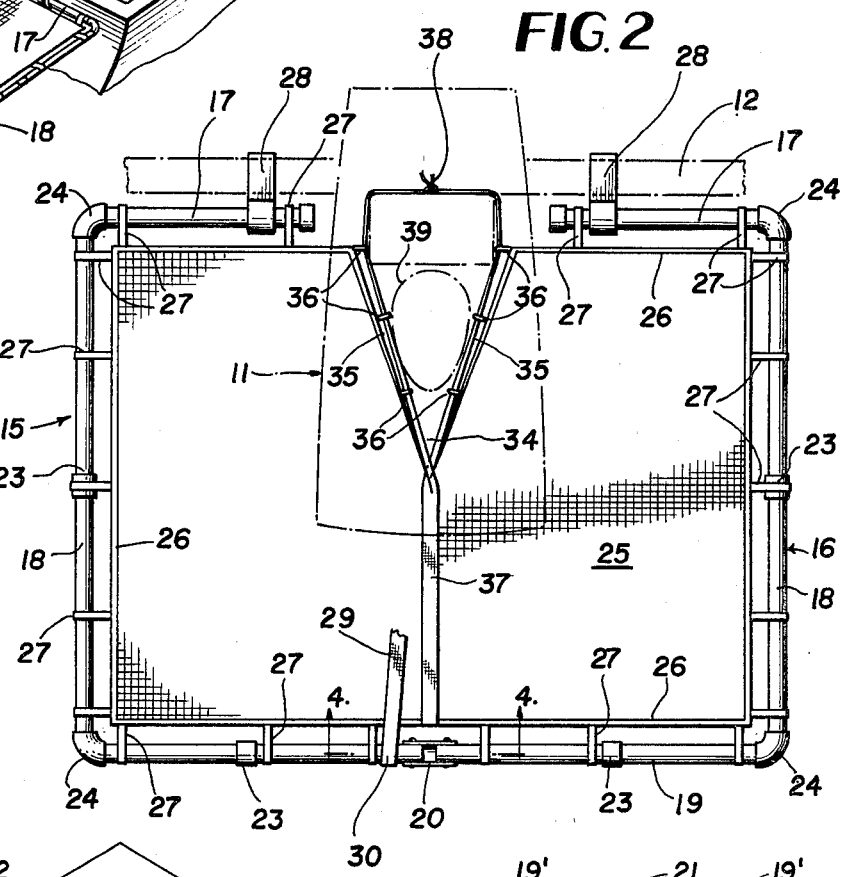
FIG. 5
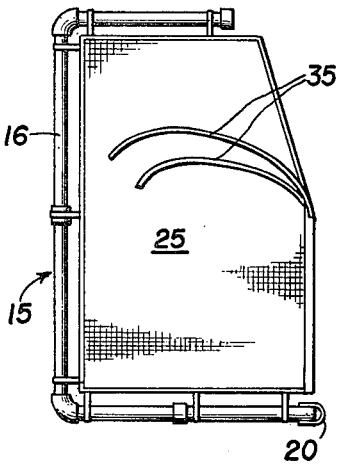
FIG. 6
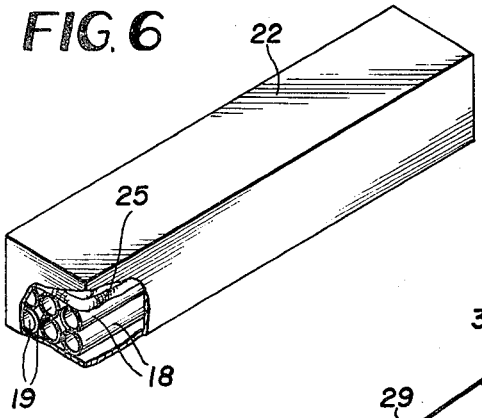
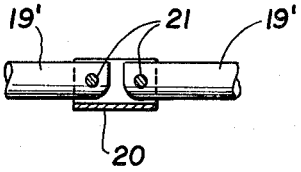
FIG. 4
FIG. 3
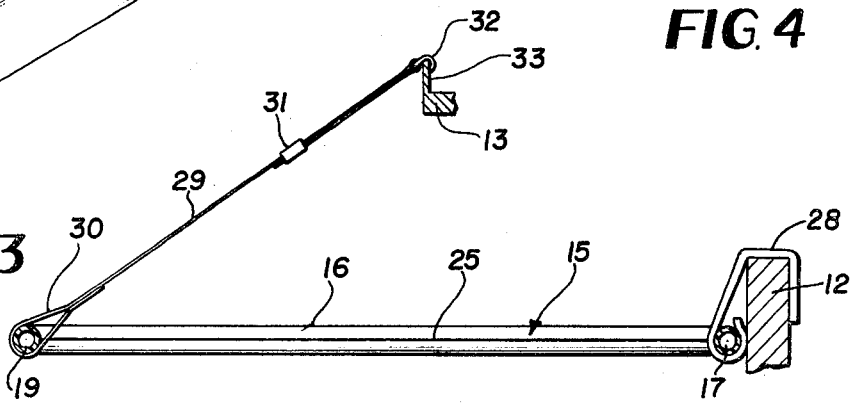

TOOL AND PARTS CATCHER FOR BOATS

This is a continuation, of application Ser. No. 112,930, filed Jan. 17, 1980, now abandoned.

BACKGROUND OF THE INVENTION

Many repairs of outboard engines on boats, such as engine tune-ups and replacement of various parts, are made at dockside in marinas by mechanics or boat owners without removing the engine from the stern of the boat. This practice, while convenient, can result in the loss of expensive tools and engine parts due to the same being accidentally dropped overboard by the mechanic or boat owner working at a position in the stern of the boat.

The objective of this invention is to completely eliminate the above problem and loss by the use of simple, convenient and inexpensive means attachable to the stern of a boat and positioned to intercept or catch tools and engine parts which may be dropped while servicing the engine, and thus prevent their permanent loss in the water.

SUMMARY OF THE INVENTION

The catcher or interceptor device according to the invention comprises a preferably foldable and/or separable marginal frame supporting a barrier body portion formed of tough netting or fabric upon which dropped tools and parts can come to rest safely and without bouncing. The barrier body portion is divided at its front equipped with ties so that it may be snugly fitted around the frame of any size outboard engine and conveniently tied off by the mechanic in the stern of the boat. The frame of the device carries suspension hooks at its forward side to engage over a boat transom and a single adjustable suspension strap on the rear of the frame can engage the frame of the outboard engine to support the catcher device in a substantially level position. The invention can be made in a folding and knock-down construction for ease of handling, storage and shipment. Convenience of use and economy are featured.

BRIEF DESCRIPTION OF THE DRAWINGS

FIG. 1 is a perspective view of the invention mounted in a use position on a boat.

FIG. 2 is an enlarged plan view of the invention, partly broken away.

FIG. 3 is a fragmentary vertical section taken on line 3—3 of FIG. 1.

FIG. 4 is a fragmentary vertical section taken on line 4—4 of FIG. 2.

FIG. 5 is a plan view of the invention in a folded state.

FIG. 6 is a perspective view of the invention in a packaged state.

DETAILED DESCRIPTION

Referring to the drawings in detail wherein like numerals designate like parts, the numeral 10 designates a boat having a conventional outboard motor 11 attached to its transom 12 by the usual clamping means, not shown. The outboard motor includes a frame 13 having a readily removable cover or housing 14 which encloses engine components requiring periodic servicing and replacement by a mechanic.

The invention proper designated by the numeral 15 comprises a marginal generally rectangular frame 16 preferably formed of substantially rigid plastic tubing or other non-corrosive material of adequate rigidity. The frame 16 comprises separated opposing forward transverse sections 17 immediately rearwardly of the transom 12 during use with their inner ends spaced from opposite sides of the outboard motor or engine. The frame further includes side longitudinal sections 18 and a rear transverse section 19 formed in two portions 19', FIG. 4, hingedly connected at the transverse center of the catcher by a U-cross section hinge element 20 having pivot elements 21 connected with the portions 19'. The hinge arrangement prevents the frame portions 19' from swinging downwardly below an approximately horizontal plane but allows them to break or swing upwardly so that the catcher 15 can be folded in half upon itself for compactness, as shown in FIG. 5.

Preferably, the supporting frame 16 of the catcher is formed in a number of readily separable telescoping sections so that the catcher can be knocked-down for shipment or storage in a container 22, FIG. 6, of convenient dimensions which will comply with mailing and shipping standards.

More particularly, adjacent frame sections may be separably joined telescopically with a friction fit by a number a coupling sleeves 23 and by elbows 24 around the perimeter of the frame 16. The respective elements which can be telescoped and separated can be marked adjacent the sleeves 23 and elbows with mating numbers, letters or other indicia for the convenience of the customer. Once the device is assembled, there is usually no reason to disassemble it and during periods of non-use, it can be folded in half, FIG. 5, and set aside at some convenient storage location.

The device further comprises a barrier body portion 25 formed of tough netting or fabric, such as fine mesh netting formed of nylon or the like. In this connection, the device can be formed entirely of non-corrosive parts to facilitate its usage around water without deterioration. The barrier body portion 25 is equipped around its reinforced edges 26 with a series of loops 27 which receive the various sections of the assembled frame 16 to support the barrier body portion 25 thereon in a spread-out condition. Preferably, the barrier body portion 25 is not completely taut and has some slack therein so that tools and engine parts dropped onto it by a mechanic working in the stern of the boat will have a cushioned landing and will not bounce. This assures that all dropped tools and parts will be intercepted by the invention and will not be lost in the water.

The device is attached quickly and easily to the boat by a pair of suspension hooks 28 adjustably mounted on the forward frame sections 17 which engage over the upper edge of the boat transom 12. A single suspension strap 29 is provided at the rear of frame 16 including a loop 30 which adjustably engages rear frame side 19 and a length adjusting means 31, such as a buckle. At its forward end, the strap 29 carries a hook 32 which can engage an upright flange 33 on engine frame 13 after removal of the cover or housing 14 by the mechanic or boat owner. The catcher can be leveled easily by adjusting the length of strap 29 and a very stable three point suspension for the catcher on the transom 12 and motor frame 13 is provided.

The flexible body portion 25 is split or divided from a point 34 near its longitudinal and transverse center through its forward edge between the separated frame sections 17. A pair of flexible ties 35 extend forwardly from the division point 34 and engage through guide rings 36 provided along the divided edges of the body portion. The ties 35 can be integral with a reinforcing tape 37 at the center of the barrier body portion 25 although this reinforcing tape is optional. The two ties 35 are of sufficient lengths to be crossed behind the descending frame 39 of the outboard motor 11 and to be drawn forwardly and around the front of the frame and knotted as at 38, after the two ties are drawn tightly around the motor frame so that the split barrier 25 will snugly embrace the descending frame 39 without gapping. This snug engagement prevents tools or parts landing on the catcher from falling through gaps or spaces around the motor frame as such is eliminated when the two ties 35 are drawn up tightly and knotted.

As depicted in FIG. 1, the catcher or barrier 15 extends for a substantial distance rearwardly of the outboard motor 11 as well as substantially on opposite sides thereof and along the transom 12 to form a wide intercept surface in all directions for tools or parts which are accidentally dropped. The dimensions of the device may be varied to suit particular needs, and in this connection the catcher can be manufactured in several sizes to accommodate boats and outboard motors of different sizes.

The device is very effective in preventing accidental loss of expensive tools and engine parts and allows the mechanic to be freed from the worry of dropping tools overboard while working. The device is very easy to install from inside the stern of the boat, is lightweight and inexpensive. It is also durable in construction so as to be long-lasting even with rough usage.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A device to prevent the loss of mechanics' tools by dropping into the water while repairing the motor of an outboard motorboat, the device comprising a frame including a pair of cooperative opposing generally C-shaped frame sections which define a generally rectangular frame when disposed in a common plane, the frame sections having parallel longitudinal side members and transverse rear members of equal lengths and the interior ends of the rear members being hingedly joined to permit folding the frame when not in use, the frame sections including foreshortened forward members having equal lengths whose inner ends are spaced apart sufficiently to straddle the sides of an outboard motor mounted on the transom of a boat to which the device is attached, a pair of suspension hooks for the device laterally adjustably mounted on said forward frame members and adapted to engage over the top of a boat transom on opposite sides of an outboard motor, at least one adjustable length flexible suspension element secured to one of said rear frame members and having a forward terminal element adapted for releasable connection with the frame of an outboard motor, whereby said device can be supported substantially horizontally immediately rearwardly of the transom of a boat, and a flexible barrier sheet adapted to intercept falling tools and the like and spanning substantially the rectangular area defined by said frame when the frame is in a use position, said barrier including a plurality of spaced suspension loops around its marginal edges and said loops being engaged with the side, rear and forward members of the frame to support the barrier sheet thereon in a generally taut state, the barrier sheet being divided at its front and transverse center between the forward frame members and said division of the barrier sheet extending longitudinally rearwardly to a point near the center of the barrier sheet, whereby the divided barrier sheet may straddle the descending portion of an outboard motor, and guide elements and a pair of flexible ties on the divided edge portions of the barrier sheet enabling the divided barrier sheet to be drawn snugly around said descending portion of an outboard motor.

* * * * *